US010245864B2

(12) United States Patent
Miyake

(10) Patent No.: US 10,245,864 B2
(45) Date of Patent: Apr. 2, 2019

(54) METHOD OF MANUFACTURING A SHEET METAL FRAME

(71) Applicant: Yasuhiro Miyake, Osaka (JP)

(72) Inventor: Yasuhiro Miyake, Osaka (JP)

(73) Assignee: KYOCERA DOCUMENT SOLUTIONS INC. (JP)

( * ) Notice: Subject to any disclaimer, the term of this patent is extended or adjusted under 35 U.S.C. 154(b) by 654 days.

(21) Appl. No.: 14/319,009

(22) Filed: Jun. 30, 2014

(65) Prior Publication Data

US 2014/0311208 A1 Oct. 23, 2014

Related U.S. Application Data

(63) Continuation-in-part of application No. 13/339,186, filed on Dec. 28, 2011, now abandoned.

(30) Foreign Application Priority Data

Dec. 28, 2010 (JP) ..... 2010-292156

(51) Int. Cl.
*B41J 29/02* (2006.01)

(52) U.S. Cl.
CPC ..... *B41J 29/02* (2013.01)

(58) Field of Classification Search
CPC ..... B41J 29/02; B21D 13/08; B21D 13/10; B21D 28/02; B21D 5/16; B21D 28/12; B21D 22/24; B21D 22/04; B21D 22/30; B26F 1/12
USPC ..... 72/379.2, 379.4, 379.6; 428/573–575
See application file for complete search history.

(56) References Cited

U.S. PATENT DOCUMENTS

| | | | | |
|---|---|---|---|---|
| 1,427,120 | A | 8/1922 | Nelson | |
| 2,443,170 | A * | 6/1948 | Smith | B21H 8/005 244/133 |
| 6,503,639 | B1 * | 1/2003 | Iwaya | B21D 25/02 428/167 |
| 6,733,899 | B2 * | 5/2004 | Uehara | H01L 21/4878 257/E23.004 |
| 6,755,069 | B1 * | 6/2004 | Pelletier | B21D 22/02 257/E23.037 |
| 2001/0013242 | A1 * | 8/2001 | Kondou | B21C 37/104 72/379.2 |
| 2008/0024965 | A1 | 1/2008 | Iwamoto et al. | |

(Continued)

FOREIGN PATENT DOCUMENTS

| | | | |
|---|---|---|---|
| DE | 102007033369 A1 * | 4/2008 | B21D 17/00 |
| JP | S 58-090320 | 5/1983 | |

(Continued)

OTHER PUBLICATIONS

Espacenet machine translation of DE 102007033369 A1.*

(Continued)

*Primary Examiner* — James S. McClellan
*Assistant Examiner* — Peter J Iannuzzi
(74) *Attorney, Agent, or Firm* — Polsinelli PC

(57) ABSTRACT

A method of manufacturing a sheet metal flame includes a step of forming at least one drawn portion in a frame main body formed into a flat plate shape, and a step of engraving groove portions into a linear shape in the frame main body at constant distances from outer edge portions of the at least one drawn portion so as to sandwich the at least one drawn portion between at least opposing sides.

4 Claims, 4 Drawing Sheets

(56) References Cited

U.S. PATENT DOCUMENTS

| | | | | |
|---|---|---|---|---|
| 2009/0165525 | A1* | 7/2009 | Schlatter | B21D 28/16 72/333 |
| 2011/0229689 | A1* | 9/2011 | Giang | B01J 19/32 428/141 |
| 2013/0099083 | A1* | 4/2013 | Gagne | F21V 21/048 248/327 |
| 2013/0196188 | A1* | 8/2013 | Sode | B21C 23/186 429/56 |
| 2013/0276504 | A1* | 10/2013 | Sukup | B21D 13/06 72/360 |
| 2015/0165504 | A1* | 6/2015 | Fukunaga | H05K 7/1488 72/379.2 |

FOREIGN PATENT DOCUMENTS

| | | |
|---|---|---|
| JP | H 07-211253 | 8/1995 |
| JP | 08-139471 | 5/1996 |
| JP | 2005-130347 | 5/2005 |
| JP | 2006-281312 | 10/2006 |
| JP | 2007-293808 | 11/2007 |

OTHER PUBLICATIONS

Human translation of DE 10 2007 033369 A1.*
Machine generated English translation for Japanese Patent Publication No. 58-90320, 2 pages, published May 30, 1983.
Machine generated English Abstract for Japanese Patent Publication No. 7-211253, 1 page, published on Aug. 11, 1995.
Machine generated English translation for Japanese Patent Publication No. 08-139471, 9 pages, published May 31, 1996.
Machine generated English translation for Japanese Patent Publication No. 2005-130347, 9 pages, published on May 19, 2005.
Machine generated English translation for Japanese Patent Publication No. 2006-281312, 14 pages, published on Oct. 19, 2006.
Machine generated English Abstract for Japanese Patent Publication No. 2007-293808, 1 page, published on Nov. 11, 2007.

* cited by examiner

--Related Art--

METHOD OF MANUFACTURING A SHEET METAL FRAME

This application is a continuation-in-part of U.S. application Ser. No. 13/339,186, filed on Dec. 28, 2011, which is based upon and claims the benefit of priority from the corresponding Japanese Patent Application No. 2010-292156 filed on Dec. 28, 2010, the entire contents of which are incorporated herein by reference.

BACKGROUND OF THE DISCLOSURE

1. Field of the Disclosure

The present disclosure relates to a method of manufacturing a sheet metal frame to be used for an electronic apparatus such as an image forming apparatus, and more particularly, to an improvement in surface accuracy and strength of a sheet metal frame.

2. Description of Related Art

Conventionally, a sheet metal frame has been widely used as a frame that constructs a casing of an electronic apparatus, or as a frame for supporting electronic components arranged inside the casing. The sheet metal frame has excellent rigidity, but as a sheet metal becomes thicker, the electronic apparatus becomes heavier, which raises a problem of a cost disadvantage.

Therefore, there is employed a method of forming a drawn portion in the sheet metal frame so as to increase the rigidity while reducing the thickness of the sheet metal frame as small as possible. For example, there is known an electronic apparatus frame having two drawn portions provided across a stay portion, to thereby increase the rigidity and strength of the frame and also enhance an anti-shock characteristic thereof. Further, there is known a structure in which an embossed portion (drawn portion) is provided in at least part of a frame of an image reading section mounted on an image forming apparatus.

By the way, in the case of forming a drawn portion in a sheet metal member as described above, there is a problem in that the sheet metal member is distorted to result in a decrease in surface accuracy. Specifically, when a drawn portion 102 is formed in a sheet metal frame 101 as illustrated in FIG. 6, a material of a corner portion 102*a* situated on a recessed surface side of the drawn portion 102 is stretched and a material of a corner portion 102*b* situated on a projecting surface side of the drawn portion 102 is compressed. As a result, the cross section of the sheet metal frame 101 is distorted into a V-shape.

SUMMARY OF THE DISCLOSURE

In view of the above-mentioned problem, the present disclosure has an object to provide a method of manufacturing a sheet metal frame having high rigidity and high surface accuracy obtained by eliminating, using a simple method, a distortion occurring due to formation of a drawn portion.

In order to achieve the above-mentioned object, according to an aspect of the present disclosure, a method of manufacturing a sheet metal flame includes a step of forming at least one drawn portion in a frame main body formed into a flat plate shape, and a step of engraving groove portions into a linear shape in the frame main body at constant distances from outer edge portions of the at least one drawn portion so as to sandwich the at least one drawn portion between at least opposing sides.

Further features and advantages of the present disclosure will become apparent from the description of embodiments given below.

DETAILED DESCRIPTION OF PREFERRED EMBODIMENTS

Figure 1:
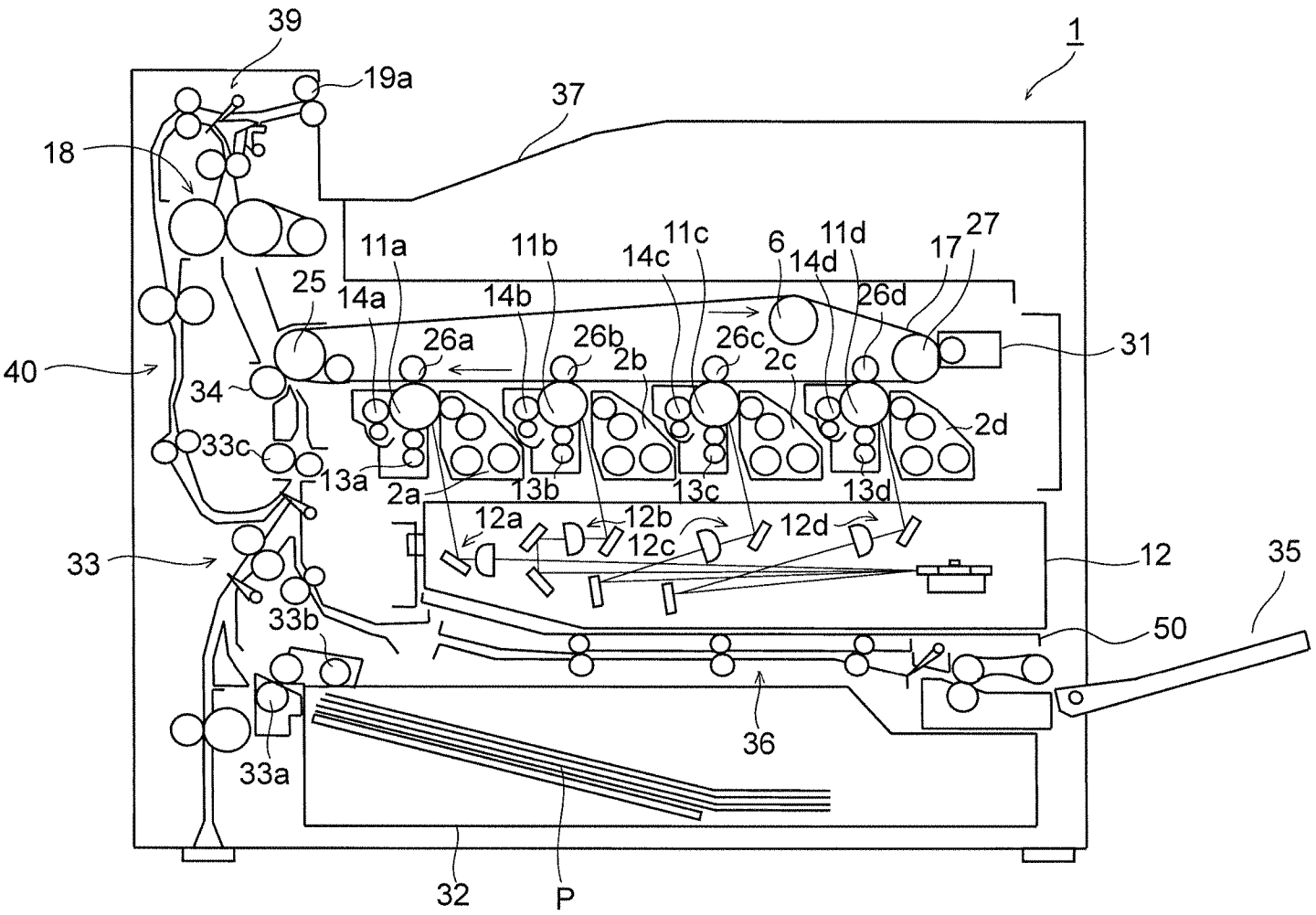
FIG. 1 is a schematic view of an image forming apparatus having a support frame 50 mounted thereon according to an embodiment of the present disclosure.

Hereinafter, an embodiment of the present disclosure is described with reference to the drawings. FIG. 1 is a schematic plan view illustrating a structure of an image forming apparatus including a support frame 50 serving as a sheet metal frame of the present disclosure. An image forming apparatus 1 is a tandem-type color printer, and includes photosensitive conductor drums 11*a* to 11*d* corresponding to respective colors of cyan, magenta, yellow, and black, the photosensitive conductor drums 11*a* to 11*d* being rotatably disposed. As the photosensitive conductor drums 11*a* to 11*d*, for example, there is used an organic photosensitive conductor member (OPC photosensitive conductor member) including an organic photosensitive conductor layer, or an amorphous silicon photosensitive conductor member including an amorphous silicon photosensitive conductor layer. On the periphery of the photosensitive conductor drums 11*a* to 11*d*, developing devices 2*a* to 2*d*, an exposure unit 12, charging devices 13*a* to 13*d*, and cleaning devices 14*a* to 14*d* are disposed, respectively.

The developing devices 2*a* to 2*d* are arranged on the right side of the photosensitive conductor drums 11*a* to 11*d* and are opposed to the photosensitive conductor drums 11*a* to 11*d*, respectively. The developing devices 2*a* to 2*d* supply toner to the photosensitive conductor drums 11*a* to 11*d*, respectively. The charging devices 13*a* to 13*d* are arranged on the upstream side of the developing devices 2*a* to 2*d* with respect to the rotation direction of the photosensitive conductor drums 11*a* to 11*d* and are opposed to the surfaces of the photosensitive conductor drums 11*a* to 11*d*, respectively. The charging devices 13*a* to 13*d* uniformly charge the surfaces of the photosensitive conductor drums 11*a* to 11*d*, respectively.

The exposure unit 12 is used for scanning and exposing to light the respective photosensitive conductor drums 11*a* to 11*d* based on image data of characters and pictures which are input from a personal computer or the like to an image input section (not shown), and is provided under the developing devices 2*a* to 2*d*. Inside the exposure unit 12, a laser light source, a polygon mirror, and reflection mirrors and lenses corresponding to the respective photosensitive conductor drums 11*a* to 11*d* are provided. Laser beams emitted from the laser light source are respectively applied to the surfaces of the photosensitive conductor drums 11*a* to 11*d* from the downstream side of the charging devices 13*a* to 13*d* with respect to the rotation direction of the photosensitive conductor drums 11*a* to 11*d* via the polygon mirror, and the reflection mirrors and the lenses. With the applied laser beams, electrostatic latent images are formed on the surfaces of the photosensitive conductor drums 11*a* to 11*d*, and those electrostatic latent images are developed into toner images by the developing devices 2*a* to 2*d*, respectively. The exposure unit 12 is supported against the support frame 50 made of a sheet metal, and is removable from and mountable on the main body of the image forming apparatus 1.

An endless intermediate transfer belt 17 is looped around a tension roller 6, a driver roller 25, and a driven roller 27. The driver roller 25 is driven to rotate by a motor (not shown), and the intermediate transfer belt 17 is driven to circulate by the rotation of the driver roller 25.

The photosensitive conductor drums 1*a* to 11*d* are arranged under the intermediate transfer belt 17 so as to come into contact with the intermediate transfer belt 17, and to adjoin each other along a conveyance direction (arrow direction of FIG. 1). Primary transfer rollers 26*a* to 26*d* are opposed to the photosensitive conductor drums 11*a* to 11*d*, respectively, while nipping the intermediate transfer belt 17. The primary transfer rollers 26*a* to 26*d* come into press contact with the intermediate transfer belt 17 to form a primary transfer section. In this primary transfer section, the toner images on the respective photosensitive conductor drums 11*a* to 11*d* are sequentially transferred onto the intermediate transfer belt 17 at predetermined timings in accordance with the rotation of the intermediate transfer belt 17. Accordingly, on the surface of the intermediate transfer belt 17, there is formed a full-color toner image obtained by the four-color, that is, cyan, magenta, yellow, and black toner images superimpose.

A secondary transfer roller 34 is opposed to the driver roller 25 while nipping the intermediate transfer belt 17. The secondary transfer roller 34 comes into press contact with the intermediate transfer belt 17 to form a secondary transfer section. In this secondary transfer section, the full-color toner image on the surface of the intermediate transfer belt 17 is transferred onto a paper sheet P. After the transfer of the full-color toner image, a belt cleaning device 31 removes the toner remaining on the intermediate transfer belt 17.

At the lower part of the image forming apparatus 1, a sheet feeding cassette 32 for receiving the paper sheet P is disposed, and on the right side of the sheet feeding cassette 32, a stack tray 35 for manually feeding a paper sheet is disposed. On the left side of the sheet feeding cassette 32, a first sheet conveyance path 33 for conveying the paper sheet P fed from the sheet feeding cassette 32 to the secondary transfer section of the intermediate transfer belt 17 is disposed. Further, on the left side of the stack tray 35, a second sheet conveyance path 36 for conveying the paper sheet fed from the stack tray 35 to the secondary transfer section is disposed. Further, at the upper left part of the image forming apparatus 1, a fixing section 18 for performing fixing processing on the paper sheet P having an image formed thereon, and a third sheet conveyance path 39 for conveying the paper sheet having undergone the fixing processing to a sheet delivery section 37 are disposed.

The sheet feeding cassette 32 is drawable to the outside of the main body of the image forming apparatus 1 (toward the front side of the drawing sheet of FIG. 1) so that paper sheets are refillable. The paper sheets P received on the sheet feeding cassette 32 are fed one by one toward the first sheet conveyance path 33 by a pickup roller 33*b* and a handling roller 33*a*.

The first sheet conveyance path 33 and the second sheet conveyance path 36 join at a position before reaching a registration roller pair 33*c*, and the paper sheet P is conveyed to the secondary transfer section by the registration roller pair 33*c* with a proper timing adjusted between the image forming operation at the intermediate transfer belt 17 and the sheet feeding operation. Onto the paper sheet P conveyed to the secondary transfer section, the full-color toner image on the intermediate transfer belt 17 is secondarily transferred by the secondary transfer roller 34 having a bias potential applied thereto, and the resultant paper sheet P is conveyed to the fixing section 18.

The fixing section 18 includes a fixing belt to be heated by a heater, a fixing roller held in contact with the inner side of the fixing belt, and a pressure roller disposed to come into press contact with the fixing roller while nipping the fixing belt. The fixing section 18 heats and pressurizes the paper sheet P having the toner image transferred thereto to perform fixing processing. After the toner image is fixed to the paper sheet P by the fixing section 18, the paper sheet P is, when needed, reversed on a fourth sheet conveyance path 40, and another toner image is secondarily transferred onto the back side of the paper sheet by the secondary transfer roller 34 and fixed thereto by the fixing section 18. The paper sheet having the toner image fixed thereto passes through the third sheet conveyance path 39 and is delivered to the sheet delivery section 37 by a delivery roller pair 19*a*.

Figure 2:
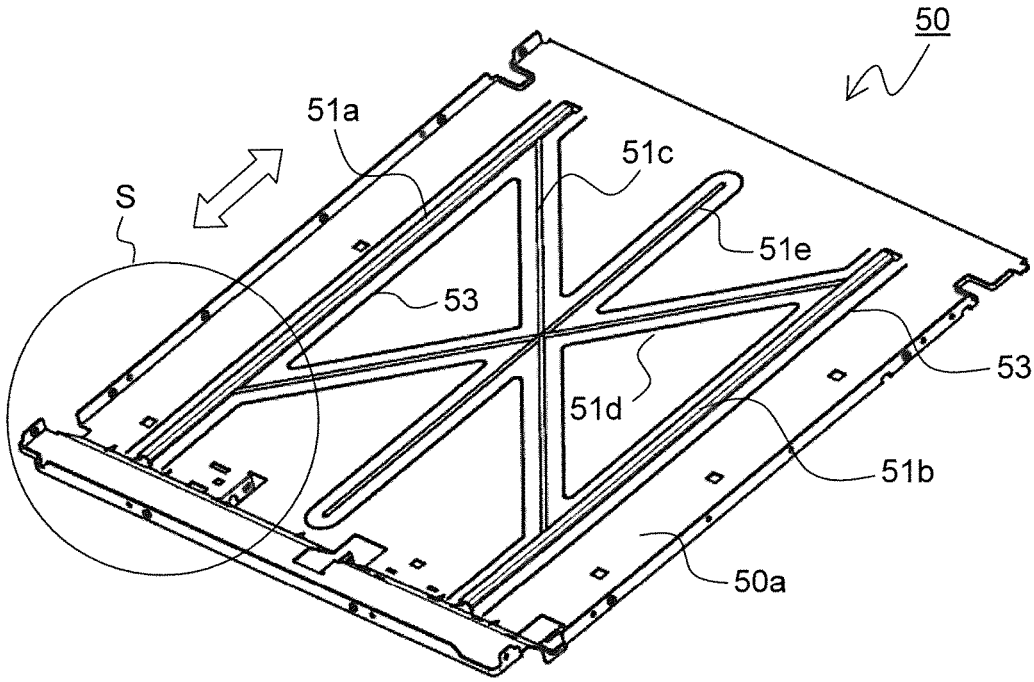
FIG. 2 is a perspective view of the support frame 50 as viewed from above according to the embodiment of the present disclosure.
Figure 3:
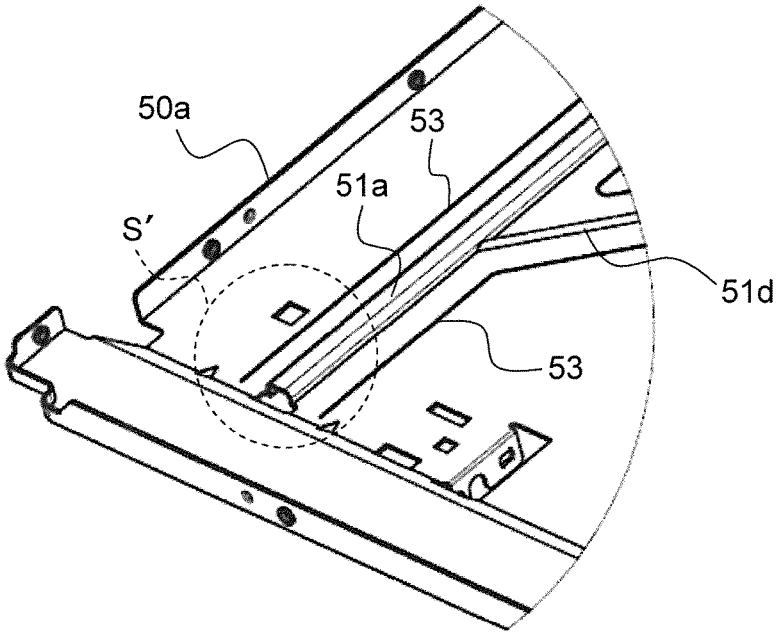
FIG. 3 is a partially enlarged view of a periphery of a corner portion of the support frame 50 according to the embodiment of the present disclosure.

FIG. 2 is a perspective view of the support frame 50 for supporting the exposure unit 12. FIG. 3 is a partially enlarged view of a corner portion of the support frame 50 (inside a solid line circle S of FIG. 2). The support frame 50 includes a frame main body 50*a* formed into a flat plate shape and formed of an electrolytic zinc-coated steel sheet (SECC). The support frame 50 supports the lower surface of the exposure unit 12 (see FIG. 1) in the main body of the image forming apparatus 1 when the exposure unit 12 is inserted and removed, and guides the removable exposure unit 12 to a predetermined position in the main body of the image forming apparatus 1. Note that, the exposure unit 12 is not fixed to the support frame 50 but is fixed to a side surface frame (not shown) inside the image forming apparatus 1 with screws or the like.

In the surface of the frame main body 50*a*, there are formed drawn portions 51*a* to 51*e* for increasing rigidity of the support frame 50 to prevent a warp and a distortion thereof. The drawn portions 51*a* and 51*b* are formed along the two opposing side edges of the frame main body 50*a*. Further, the drawn portions 51*c* to 51*e* are formed radially from the center of the frame main body 50*a*, and the drawn portions 51*c* and 51*d* extend up to the drawn portions 51*a* and 51*b*. The drawn portions 51*a* to 51*e* are provided by, for example, subjecting the frame main body 50*a* to a drawing process using a press machine.

The drawn portions 51*a* and 51*b* are provided to extend along the inserting and removing directions of the exposure unit 12 (directions indicated by the white arrow of FIG. 2), and serve also as guide rails to be used when the exposure unit 12 is inserted and removed along the support frame 50. The shape of the drawn portions 51*c* to 51*e* is not particularly limited, but when the drawn portions to be provided are set as long in the surface direction of the frame main body 50*a* as possible, the structure of the support frame 50 becomes more resistant to a warp and a deflection. In this embodiment, the drawn portions 51*c* to 51*e* are arranged radially to obtain such a structure that a warp and a distortion do not easily occur even in a case where loads are applied to the support frame 50 from various directions.

Further, linear groove portions 53 are engraved so as to surround the drawn portions 51*a* to 51*e*. At the bent portions formed at the time of forming each of the drawn portions 51*a* to 51*e*, a compressive stress is generated on the inner side and a tensile stress is generated on the outer side. Those compressive stress and tensile stress become larger toward the surface of the sheet metal, and emerge as a distortion of the frame main body 50*a*. Therefore, the groove portions 53 are engraved after the drawn portions 51*a* to 51*e* are formed, and accordingly the stresses generated on the surface of the sheet metal are dispersed by the groove portions 53. As a result, the distortion of the frame main body 50*a* can be corrected.

The groove portions 53 are engraved at constant distances from the outer edge portions of each of the drawn portions 51*a* to 51*e*, and surround the substantially entire region of the drawn portions 51*a* to 51*e* except for both end portions of the drawn portions 51*a* and 51*b*. This is because openings 55 (see FIG. 4) are formed at both the end portions of the drawn portions 51*a* and 51*b*, and hence the compressive stress and the tensile stress are not generated. Thus, there is no need to engrave the groove portions 53 at those portions.

Further, the groove portions 53 produce a greater effect of correcting the distortion as the range of surrounding the drawn portions 51*a* to 51*e* becomes wider, and the distortion correcting effect becomes greatest when the drawn portions 51*a* to 51*e* are completely surrounded. Note that, in order to correct the distortion to an insignificant level in practical use, the groove portions 53 do not need to completely surround the drawn portions 51*a* to 51*e*, but the groove portions 53 need to be engraved at least along the two directions opposed across the drawn portions 51*a* to 51*e*.

Figure 4:
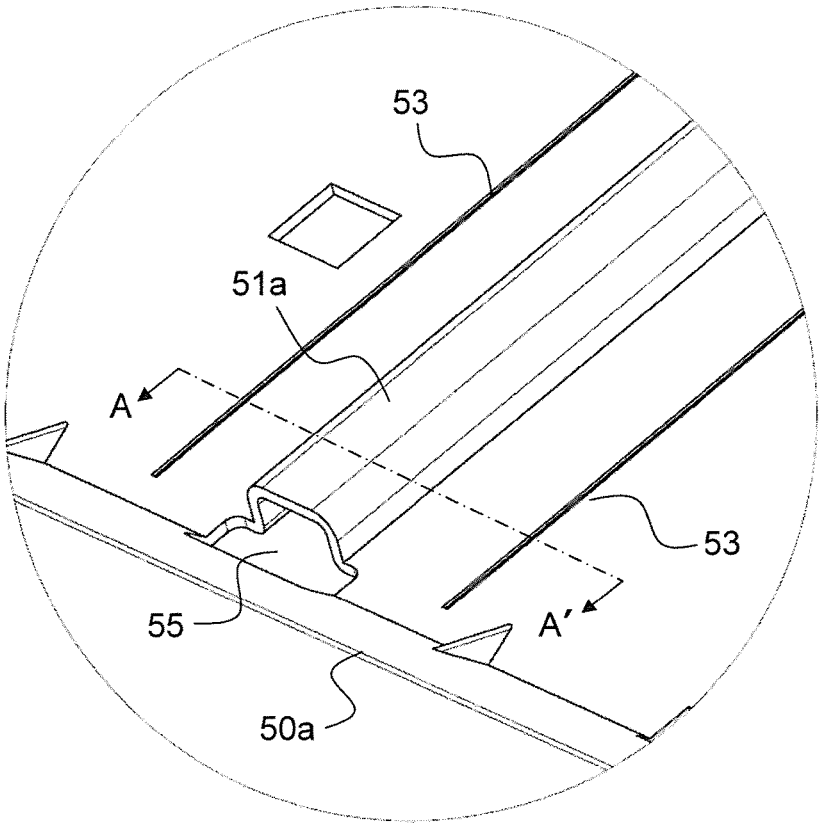
FIG. 4 is a partially enlarged view of a periphery of a drawn portion 51*a* of the support frame 50 according to the embodiment of the present disclosure.
Figure 5:
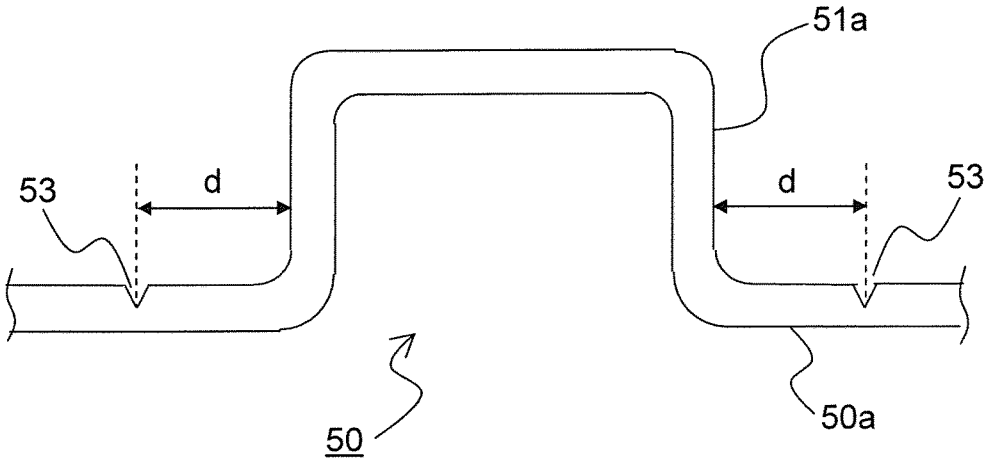
FIG. 5 is a partial sectional view of the periphery of the drawn portion 51*a* of the support frame 50 according to the embodiment of the present disclosure.
Figure 6:
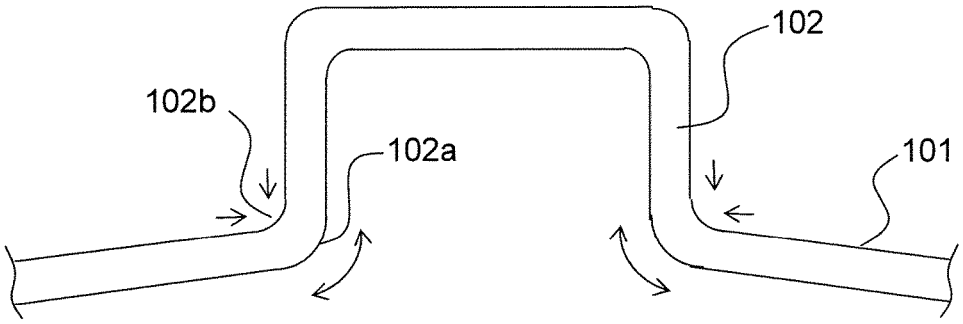
FIG. 6 is a partial sectional view illustrating a state in which a drawn portion 102 is formed in a conventional sheet metal frame 101.

FIG. 4 is a partially enlarged view of a periphery of an end portion of the drawn portion 51*a* (inside a broken line circle S' of FIG. 3). FIG. 5 is a partial sectional view (sectional view taken along the arrow AA' of FIG. 4) of the periphery of the drawn portion 51*a*. In this embodiment, the groove portions 53 are engraved from a projecting side of the drawn portions 51*a* to 51*e* (from the upper side of FIG. 5). The distortion correcting effect is obtained also in a case where the groove portions 53 are engraved from a recessed side of the drawn portions 51*a* to 51*e*, but the distortion correcting effect is greater when the groove portions 53 are engraved from a direction opposite to the direction in which the drawn portions 51*a* to 51*e* are formed through the drawing process (bottom-to-top direction of FIG. 5). Further, distances d each ranging from the outer edge portion of each of the drawn portions 51*a* to 51*e* to the groove portion 53 are set substantially equal to each other on both sides of each of the drawn portions 51*a* to 51*e*. Accordingly, the distortion occurring due to formation of the drawn portions 51*a* to 51*e* can be corrected substantially equally on both sides of each of the drawn portions 51*a* to 51*e*.

The distance d ranging from the outer edge portion of each of the drawn portions 51*a* to 51*e* to the groove portion 53 and the depth of the groove portion 53 may be set as appropriate depending on the thickness, the material, and the like of the sheet metal that forms the frame main body 50*a*, but when the distance d is excessively large or the depth of the groove portion 53 is excessively small, the distortion correcting effect becomes poor. On the other hand, when the depth of the groove portion 53 is excessively large, the strength of the support frame 50 is decreased at the part at which the groove portions 53 are provided. In this embodiment, the frame main body 50*a* has a thickness of 0.8 mm, the groove portion 53 has a depth of 0.3 mm, and the distance d ranges from 5 mm to 10 mm.

Besides, the present disclosure is not limited to the above-mentioned embodiment, and various modifications may be made thereto without departing from the spirit of the present disclosure. For example, the description of this embodiment is directed to the support frame 50 for the exposure unit 12 as an example of the sheet metal frame, but needless to say, the present disclosure is also applicable to a sheet metal frame arranged at a different part of the image forming apparatus 1 or a sheet metal frame for an electronic apparatus other than the image forming apparatus.

Further, in the above-mentioned embodiment, the drawn portions 51*a* to 51*e* having a rib shape are formed in the support frame 50, but the shape and size of the drawn portions may also be modified as appropriate within the scope of the object of the present disclosure, depending on the position of arrangement of the sheet metal frame and the purpose of arrangement.

The present disclosure is applicable to a sheet metal frame to be used for an electronic apparatus such as an image forming apparatus, and in the sheet metal frame, linear groove portions are engraved at constant distances from the outer edge portions of each drawn portion formed in a frame main body so as to sandwich the drawn portion between at least opposing sides. By applying the present disclosure, it is possible to increase the rigidity and surface accuracy of the sheet metal frame with a simple structure, and to provide an electronic apparatus which is reduced in thickness and weight as compared to the conventional electronic apparatus and has an improved arrangement accuracy of components and an excellent strength.

What is claimed is:

1. A method of manufacturing a sheet metal frame, comprising:

a step of forming at least one drawn portion in a frame main body formed into a planar shape such that the at least one drawn portion projects in a surface direction from a planar portion of the frame main body; and a step of, after forming the at least one drawn portion, engraving, from a projecting side of the at least one drawn portion, groove portions stretched to have a linear shape in the planar portion of the frame main body at a distance of 5 to 10 mm from a boundary portion between the planar portion and the at least one drawn portion so as to surround an entire region of at least one drawn portion.

2. The method according to claim 1, wherein the groove portions are engraved at equal distances from the outer edge portions of the at least one drawn portion.

3. The method according to claim 1, wherein the at least one drawn portion is formed radially from a center of the frame main body.

4. The method according to claim 1, wherein an opening is formed in an end portion of the at least one drawn portion, and the groove portions are formed so as to surround the entire region of the at least one drawn portion except in the end portion thereof where the opening is formed.

* * * * *